US006243535B1

(12) United States Patent
Bochud

(10) Patent No.: US 6,243,535 B1
(45) Date of Patent: Jun. 5, 2001

(54) STEAM GENERATOR

(75) Inventor: Eric Bochud, Granges-Paccot (CH)

(73) Assignee: Ecovap S.A., La Chaux-de-Fonds (CH)

( * ) Notice: Subject to any disclaimer, the term of this patent is extended or adjusted under 35 U.S.C. 154(b) by 0 days.

(21) Appl. No.: 09/367,350

(22) PCT Filed: Feb. 12, 1998

(86) PCT No.: PCT/IB98/00171

§ 371 Date: Aug. 12, 1999

§ 102(e) Date: Aug. 12, 1999

(87) PCT Pub. No.: WO98/36215

PCT Pub. Date: Aug. 20, 1998

(30) Foreign Application Priority Data

Feb. 14, 1997 (CH) ..... 324/97

(51) Int. Cl.[7] ..... F24H 1/18
(52) U.S. Cl. ..... 392/459; 392/447; 392/475
(58) Field of Search ..... 392/441, 444, 392/447, 465, 475, 477, 497, 498, 500, 501, 503

(56) References Cited

U.S. PATENT DOCUMENTS

| | | | | |
|---|---|---|---|---|
| 4,414,037 | | 11/1983 | Friedheim . | |
| 5,367,607 | * | 11/1994 | Hufnagel et al. | 392/465 |
| 5,835,680 | * | 11/1998 | Glucksman et al. | 392/501 |
| 5,881,207 | * | 3/1999 | DeBourg et al. | 392/401 |

FOREIGN PATENT DOCUMENTS

| | | |
|---|---|---|
| 11 17 228 | 11/1961 | (DE) . |
| 32 23 193 | 12/1983 | (DE) . |
| 44 43 798 | 3/1996 | (DE) . |
| 0 238 955 | 9/1987 | (EP) . |

* cited by examiner

*Primary Examiner*—Teresa Walberg
*Assistant Examiner*—Thor Campbell
(74) *Attorney, Agent, or Firm*—Young & Thompson

(57) ABSTRACT

The steam generator includes a cast aluminum hollow body in which is embedded a heating element, the ends of which are to be connected to a power source projecting from the body. A cover is sealed on a flange of the body, all the connections required for water inflow and outflow being arranged on the cover. The aluminum hollow body is cast over a receptacle disposed within the body.

10 Claims, 5 Drawing Sheets

STEAM GENERATOR

BACKGROUND OF THE INVENTION

The present invention has for its object a steam generator and more particularly a steam generator for domestic apparatus such as irons or steam cleaners for example.

Conventionally, steam generators for domestic apparatus comprise a hermetically sealed receptacle, provided with a water inlet and a steam outlet as well as a safety valve, in which is disposed a heating body. These steam generators have drawbacks particularly due to the fact that the heating body in contact with water becomes covered with scale and is difficult to descale and that it is necessary to provide sealed passages through the wall of the receptacle to supply electricity to the heating body.

SUMMARY OF THE INVENTION

The present invention has for its object a steam generator adapted to overcome the mentioned drawbacks.

The object of the present invention is the provision at low cost of a reliable, durable, easily descalable steam generator of high quality particularly as to its lifetime and its possibilities of adjusting the power delivered to the heating body. Another object of the present invention is to prevent the heating body from being in contact with water contained in the sealed receptacle.

The present steam generator is distinguished by the characteristics recited herein.

BRIEF DESCRIPTION OF THE DRAWINGS

The accompanying drawing shows schematically by way of example one embodiment of the steam generator according to the invention.

DETAILED DESCRIPTION OF THE PREFERRED EMBODIMENTS

Figure 2:
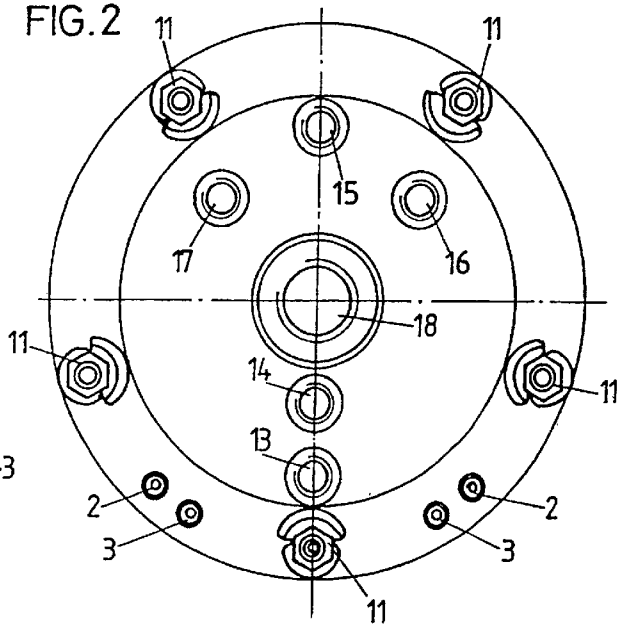
FIG. 2 is an end view on a larger scale of the steam generator.
Figure 3:
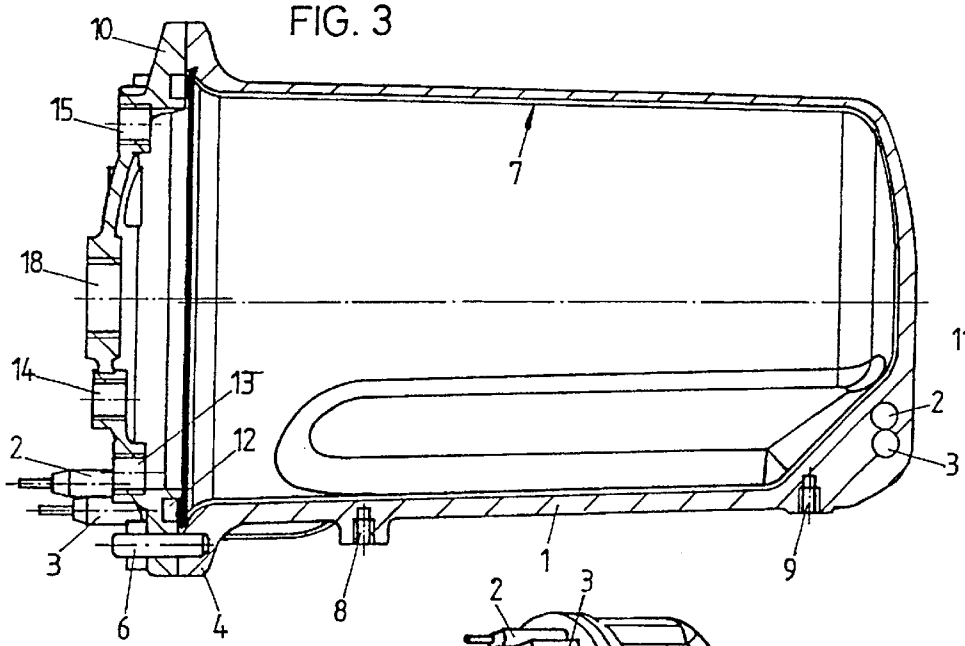
FIG. 3 is a longitudinal cross-sectional view on a larger scale of the steam generator.
Figure 1:
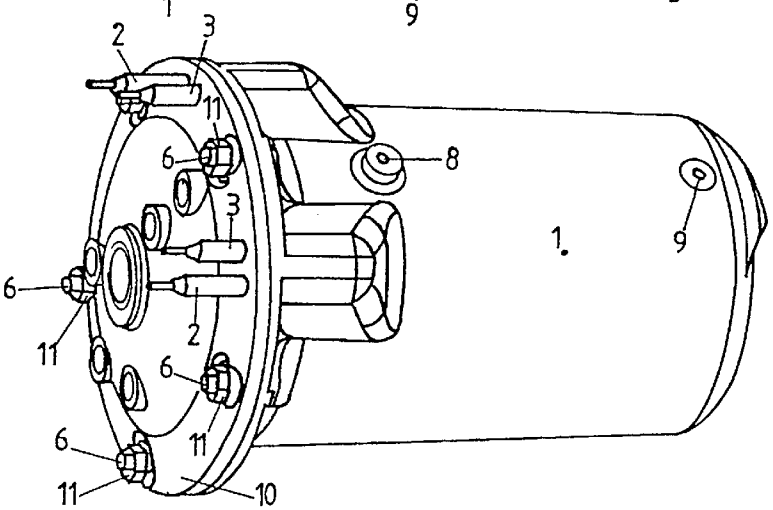
FIG. 1 is a perspective view of the steam generator.
Figure 4:
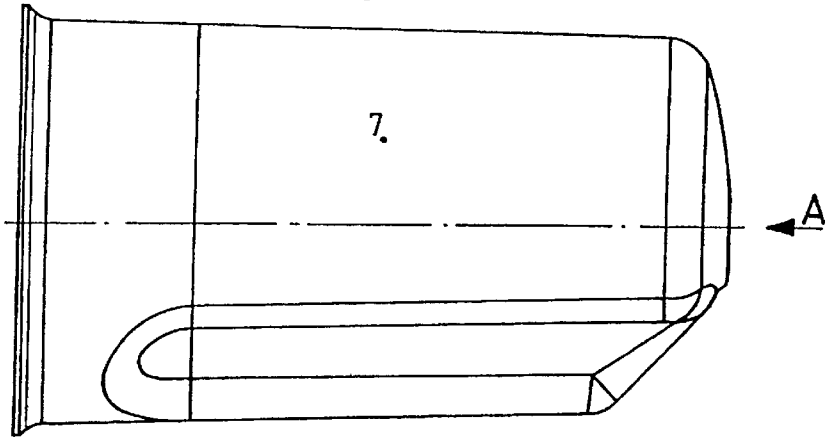
FIG. 4 is a side elevational view of the receptacle of the steam generator.
Figure 5:
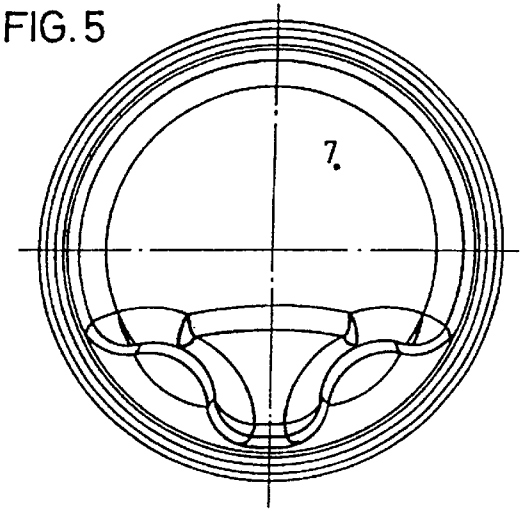
FIG. 5 is a view in the direction of the arrow A of the receptacle shown in FIG. 4.
Figure 6:
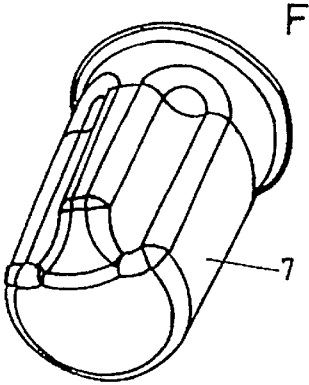
FIG. 6 is a perspective view of the receptacle of the steam generator.
Figure 9:
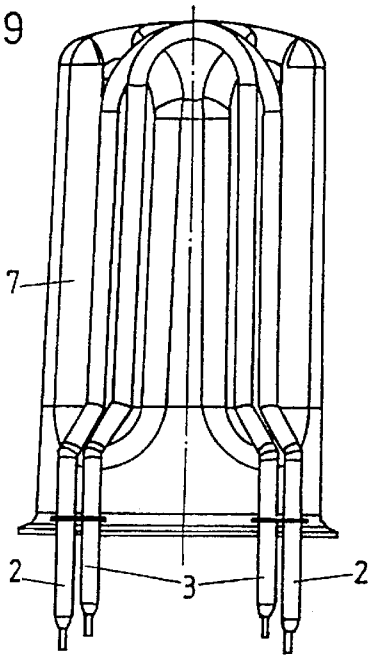
FIGS. 9–12 show the assembly of FIGS. 7 and 8 in a bottom plan view, in elevation, from the bottom end and from the open end of the receptacle.
Figure 12:
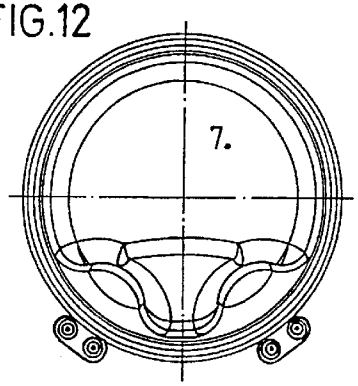
Figure 8:
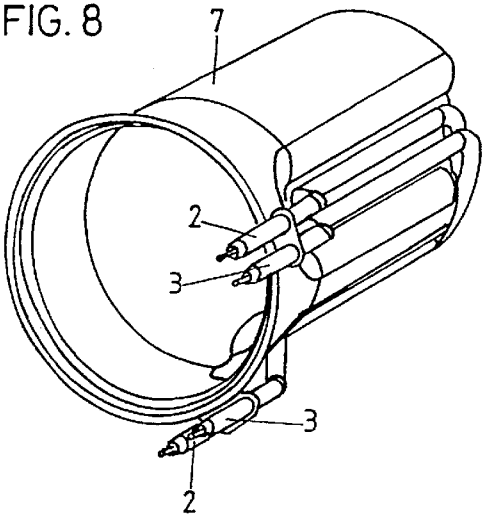
FIGS. 7 and 8 show in perspective an assembly formed from the receptacle and two heating bodies.
Figure 10:
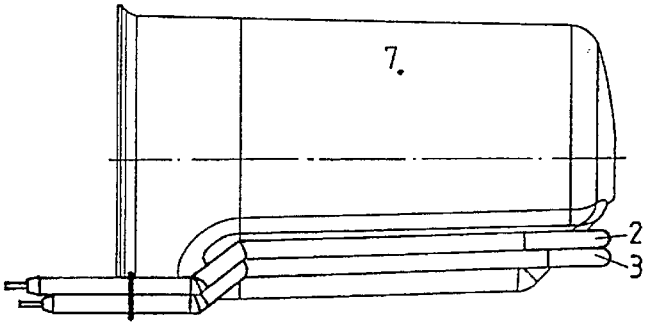
Figure 7:
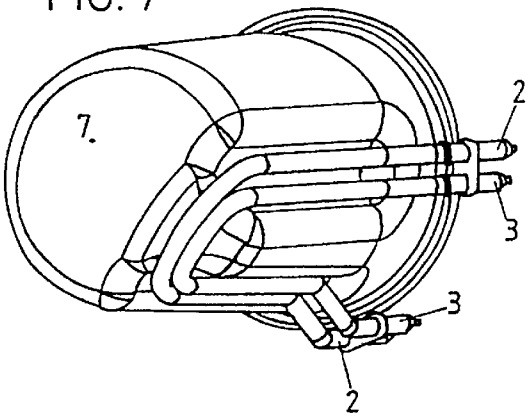
Figure 11:
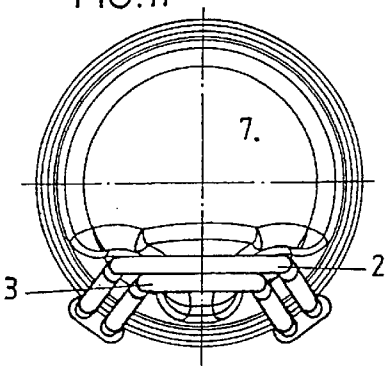

The illustrated steam generator comprises a hollow one-piece body 1 of die cast aluminum, within the body of which are embedded one or two heating bodies 2, 3 of which the ends to be connected to a source of electric energy emerge from the open front surface of the body 1 in a portion of the latter forming a flange 4. This flange 4 of the body 1 also comprises means for securement of a cover 5, in this instance studs 6 embedded in the body 1.

As a modification, the securement means could be constituted by tapped holes coacting with screws or by untapped holes coacting with self-tapping screws.

This one-piece body 1 of die cast aluminum is lined during manufacture with a receptacle 7 of stamped stainless steel. This receptacle 7 has a circular or oval opening that is flared out and stops slightly short of the front surface of the flange 4 and recesses permitting the positioning of the heating bodies 2, 3 before injection molding of the aluminum.

The production of this assembly is special, the receptacle 7 and the heating bodies 2, 3 are positioned as well as the studs 6, in their relative position shown in FIGS. 8 to 11, on the moveable core of a mold. This two-part mold is then closed on the core and the molten aluminum is injected into said mold. Molten aluminum entirely surrounds the heating bodies 2, 3 and ensures upon shrinking or cooling its securement on the stainless steel receptacle 7. Of course the receptacle 7 should be heated before injection of the molten aluminum and the dimensions determined both of the mold and of this receptacle 7 so that the finished assembly will have perfect positioning of the receptacle 7 against the aluminum body 1 at the operating temperature of the steam generator, about 140° C., whilst avoiding too great a stress on the stainless steel receptacle 7. There is thus obtained a monolithic assembly permitting excellent transmission of heat and the complete protection of the heating bodies 2, 3. The presence of the stainless steel receptacle 7 gives to this steam generator a quality, long life and descaling possibilities which are optimum.

It is however evident that in a less expensive embodiment of the steam generator, the receptacle 7 of stainless steel can be omitted, the water then being in contact with the mass of die cast aluminum. For such an embodiment, the female portion of the production mold is identical to the preceding, except the core is slightly larger. Thus, the same mold can be used for the two modifications, low cost and deluxe, of the steam generator, which permits reducing the cost.

It will be moreover noted that the heating bodies 2, 3 are totally embodied in the body 1 of cast aluminum and that they are never in contact with the water. The sealing of the receptacle 7 takes place, as will be seen further on, over a diameter less than that on which are arranged the ends of the heating bodies 2, 3 emerging from the flange 4, and so there are no sealing passages to be provided for these heating bodies, which also reduces the cost and increases the reliability of the steam generator.

The one-piece aluminum body 1 also comprises recesses 8, 9, formed during injection, to receive temperature detectors which are connected to the controls of the steam generator.

This body 1 is covered with an insulating sleeve (not shown) to avoid heat loss and to avoid burning the users.

Figure 14:
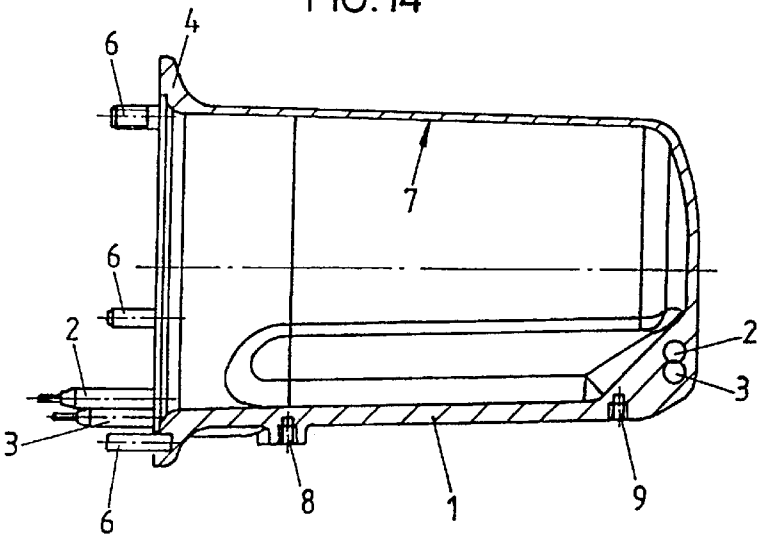
FIG. 14 is a longitudinal cross-section of this one-piece aluminum body.
Figure 13:
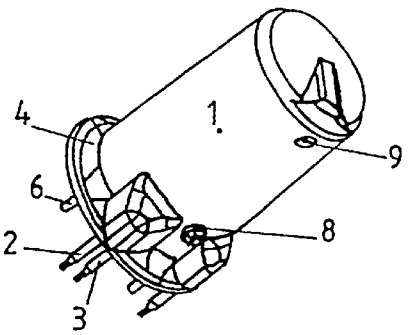
FIG. 13 shows in perspective the one-piece aluminum body of the steam generator.
Figure 15:
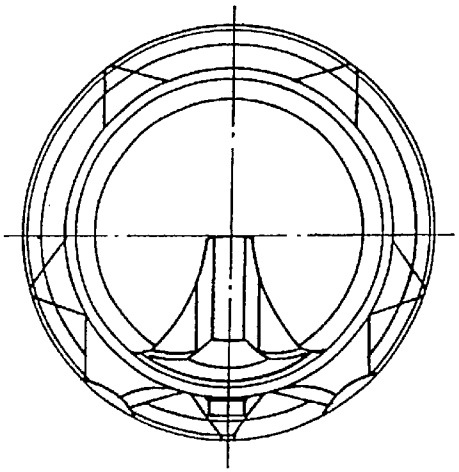
FIG. 15 is an end view, from the bottom, of the one-piece aluminum body.
Figure 17:
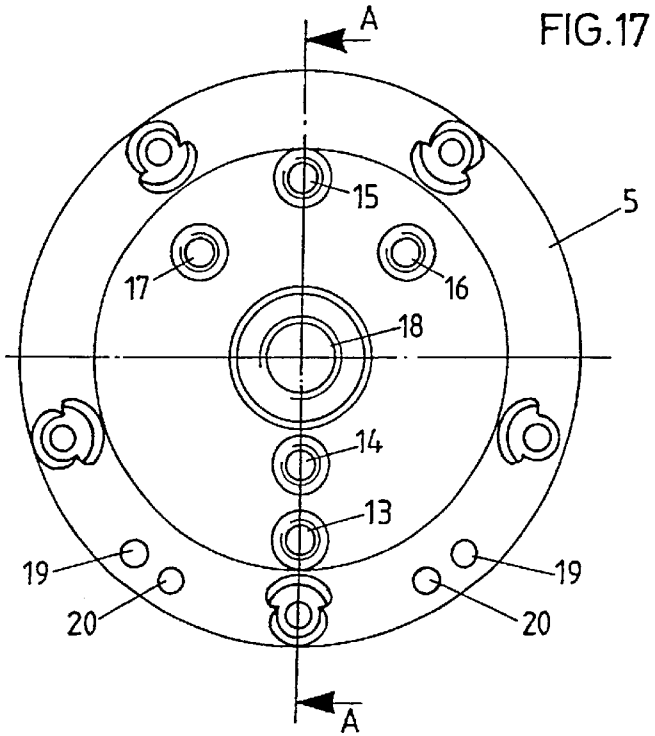
FIG. 17 is a plan view of this cover.
Figure 16:
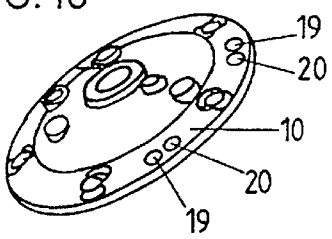
FIG. 16 is a perspective view of the aluminum plate or cover.
Figure 18:
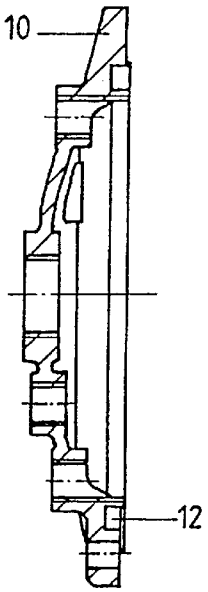
FIG. 18 is a cross-section on the line A—A of FIG. 17.

As will be seen particularly in FIG. 14, the stainless steel receptacle 7 is slightly eccentric relative to the die cast aluminum body 1. In this way, the aluminum of the body 1 is larger about the heating bodies 2, 3, which ensures a higher thermal inertia, which is favorable to control of the steam generator.

This steam generator also comprises a cover 10 of die cast aluminum or stainless steel to be secured to the free surface of the flange 4 of the body 1 and secured to this latter with the help of nuts 11 screwed on the studs 6 of the body 1. The internal surface of this cover 10 comprises a circular groove 12 adapted to receive an O-ring (not shown). When this cover 10 is fixed in position on the body 1 of the steam generator, the O-ring joint bears on the one hand within the groove 12 of the cover but on the other hand on the flange 4 of aluminum or on the flared edge of the opening of the stainless steel vessel 7 when the latter is present. There is thus ensured a minimum distance between the steel of the vessel 7 and the aluminum of the cover 10, permitting avoiding any battery effect whilst ensuring the sealing of the assembly. This also permits avoiding any battery effect between the receptacle 7 and the body 1.

In addition to the five holes uniformly distributed about its periphery, giving passage to the studs 6, the cover 10 also comprises several screw-threaded holes adapted for connections or the securement of control or safety elements.

The hole 13 is adapted to be connected to an outlet conduit for water during a descaling cycle of the receptacle. The hole 14 is adapted to be connected to a cold water inlet pump. This hole is provided with a tube (not shown), generally a flexible silicone tube, extending within the receptacle (7) up to adjacent the bottom of the latter. Thus, during an automatic descaling cycle, the descaling mixture penetrates through this tube and necessarily sweeps all the internal surface of the receptacle 7 before evacuated through the hole 13. The hole 15 is itself adapted to be connected to an outlet conduit for the produced steam. The hole 16 serves to fix a safety valve limiting the maximum pressure within the steam generator. Finally, the hole 17 serves for fixing a discharge valve permitting the penetration of air into the interior of the steam generator when the pressure within the latter falls below a pre-established value, generally 1 bar. Finally, the central hole 18 serves for the securement of a detector of the water level in the steam generator by the inclination of an angular detector introduced in a float. Such a mechanical detector is reliable and resistant to scaling.

The periphery of this cover 10 of course comprises other holes 19, 20 giving passage to the ends of the heating bodies 2, 3 that must be electrically connected.

Another advantage of the described generator is its multiple uses. When it is used with a steam cleaner which requires a high flow rate of steam, the two heating bodies 2, 3 are supplied to obtain maximum heating power. On the contrary, if the generator is used with an iron or a suction motor requiring less steam flow, only one of the heating bodies is supplied. In this case, using a supply device identical to that used by the steam cleaner, the power that remains available can be used for heating the iron.

The design of this steam generator permits its reliability, its optimization and its multiple uses. Thus, because the heating bodies are embedded in the mass of the body, they are no longer subjected to scaling. Moreover, if the electrical supply of these heating bodies requires no sealed passage. Finally, the mass of the die-cast aluminum body is greater in the region in which are embedded the heating bodies, which increases the thermal inertia and facilitates regulation of the heating bodies.

The economy model, and the deluxe model with a stainless steel receptacle 7, can be produced with the same female mold part, which reduces the cost of tooling.

All the sealed outlets are gathered on the cover, thereby simplifying the production of the body and the receptacle.

Finally, the fact of providing two independent heating bodies permits using the generator with a same supply device for different applications.

The fact of providing a discharge valve permits guaranteeing the stability of the adjusted parameters, such as the water level of the generator during its operation, which in turn permits better optimization of the control of the steam generator.

What is claimed is:

1. A steam generator comprising:

a hollow body having a flange surrounding an opening;

at least one heating body embedded in said hollow body and whose ends to be connected to a source of electrical energy emerge from said hollow body;

a cover fixed in a sealed manner on said flange;

grouped connections on said cover for water inlet, water outlet and steam removal; and a stainless steel receptacle disposed within said hollow body and wherein said hollow body is of aluminum cast over said receptacle.

2. The generator according to claim 1, wherein two independent heating bodies are embedded in said hollow body.

3. The generator according to claim 1, wherein said hollow body has a wall thickness greater in the region in which said heating bodies are embedded than in the rest of said hollow body.

4. The generator according to claim 1, wherein said cover further comprises connections for a temperature probe and a safety valve.

5. The generator according to claim 1, wherein said cover further comprises a connection for a discharge valve permitting the entry of air into the generator when the internal pressure of the latter falls below a predetermined value.

6. The generator according to claim 1, further comprising a joint disposed in a circular groove of said cover, said joint pinched between said cover and said flange of said hollow body or the edge of said receptacle.

7. The generator according to claim 1, wherein said receptacle comprises stamped stainless steel and includes recesses for passage of said heating bodies and has no separate connection.

8. The generator according to claim 1, wherein said cover includes a passage adapted for the inlet of cold water into said receptacle and a tube extending adjacent the bottom of said receptacle.

9. The generator according to claim 1, wherein said cover further comprises a hole for removal of descaling liquid located below the passage for the introduction of water into said receptacle and communicates with the lower portion of said receptacle.

10. The generator according to claim 1, further comprising a water level detector constituted by an angular detector disposed in a float.

* * * * *